United States Patent [19]

Lensing

[11] Patent Number: 5,067,623

[45] Date of Patent: Nov. 26, 1991

[54] CLOSURE FOR A CONTAINER

[76] Inventor: Rudolf Lensing, Hinterdorfstrasse 28, D 7947 Mengen-Rulfingen, Fed. Rep. of Germany

[21] Appl. No.: 556,162

[22] Filed: Jul. 20, 1990

[51] Int. Cl.[5] ..... B65D 51/28

[52] U.S. Cl. ..... 215/227; 215/228; 215/230; 215/252; 215/253

[58] Field of Search ..... 215/1 R, 203, 220, 227, 215/228, 230, 252, 253

[56] References Cited

U.S. PATENT DOCUMENTS

| | | | |
|---|---|---|---|
| 1,865,023 | 6/1932 | Leavy | 215/227 |
| 2,172,159 | 9/1939 | Conner et al. . | |
| 2,950,834 | 8/1960 | Mazza . | |
| 3,262,596 | 7/1966 | Zillmann | 215/227 X |
| 3,768,688 | 10/1973 | Linke | 215/227 X |
| 4,401,227 | 8/1983 | Pehr | 215/252 |
| 4,720,351 | 1/1988 | Flynn et al. | 215/227 X |
| 4,759,456 | 7/1988 | Kusz | 215/252 |

FOREIGN PATENT DOCUMENTS

| | | |
|---|---|---|
| 1401450 | 4/1965 | France . |
| 2252751 | 6/1975 | France . |
| 2368419 | 5/1978 | France . |
| 2523551 | 9/1983 | France . |

*Primary Examiner*—Stephen Marcus
*Assistant Examiner*—Nova Stucker
*Attorney, Agent, or Firm*—Robert W. Becker & Associates

[57] ABSTRACT

A closure for a container, especially a medicine bottle, is provided. The closure has a cap that can be placed onto the mouth of the container and, to accommodate an enclosure, has a receiving chamber disposed concentric to the cap. The closure is detachably connected to the container via two or more arms or attachments.

16 Claims, 3 Drawing Sheets

CLOSURE FOR A CONTAINER

BACKGROUND OF THE INVENTION

The present invention relates to a closure for a container, especially a medicine bottle, and includes a cap that can be placed onto the mouth of a container.

Various forms of such closures are known, and are frequently used with containers for special products such as medicines, ink, dyes, lacquers, poisons or toxic agents, etc. In order to provide a user with instructions or other information concerning the use, storage, possible side effects, etc., of the respective product, it is generally necessary to include an enclosure for each container. In order to be able to this, it has up till now been necessary to place the containers in separate packages that then also accommodate the respective enclosures, which are in the form of information sheets.

Unfortunately, these generally printed-upon packages, which are in the form of a six-sided cardboard box, require not only considerable space during transport and during the time that the packaged product is stored, but in addition these packages are expensive to produce and often cause disposal problems since they are throw-away packages. Furthermore, a separate packaging process cannot be avoided in order to introduce a filled container as well as the accompanying enclosure into the packaging. Furthermore, with containers that are packaged in this way, it is easy to interchange the associated enclosures and/or packaging.

It is therefore an object of the present invention to improve a closure of the aforementioned general type in such a way that an additional, expensive packaging for the container can be eliminated, yet an enclosure or information sheet can be included with the container. Furthermore, it should be easy to recognize if the closure has been tampered with or if the enclosure has been interchanged or removed. Furthermore, the expense for realizing this should be kept low, and the closure should be easy to handle.

BRIEF DESCRIPTION OF THE DRAWINGS

These and other objects and advantages of the present invention will appear more clearly from the following specification in conjunction with the accompanying schematic drawings, in which.

SUMMARY OF THE INVENTION

Figure 1:
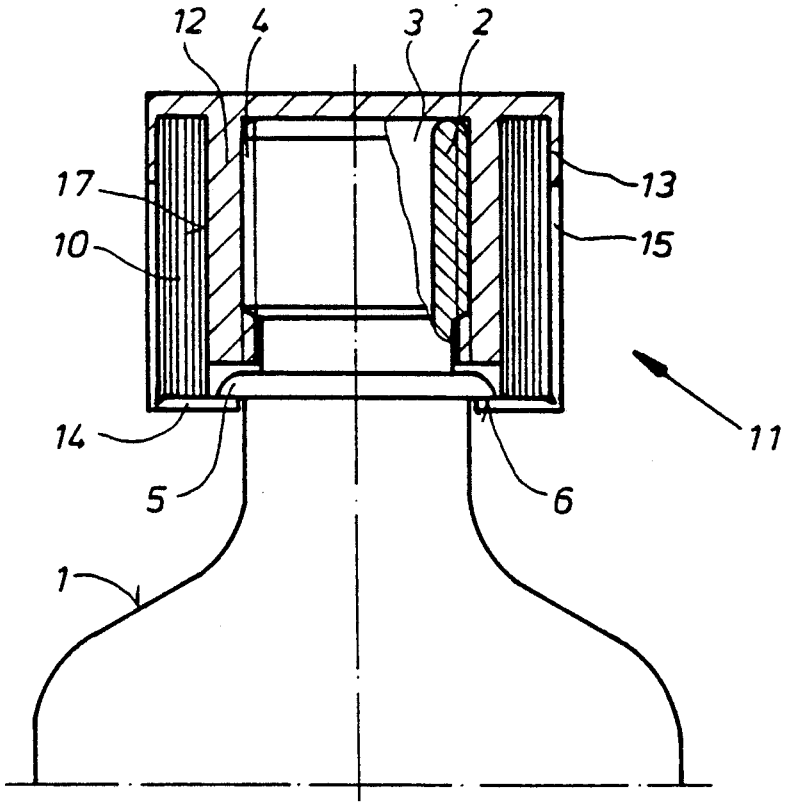
FIG. 1 is a partially cross-sectioned view of one exemplary embodiment of the inventive closure placed upon a container, with the closure having integrated in its cap a receiving chamber for an enclosure.

The closure of the present invention is characterized primarily in that, in order to accommodate an enclosure or information sheet, the closure is provided with a receiving chamber that is disposed concentric to and radially outwardly of the cap; in addition, the closure is detachably connected to the container via two or more arms (or attachments thereof), a retaining ring, a sealing seam, etc.

Pursuant to one straightforward embodiment, the receiving chamber can be formed by two or more radially resilient arms that are formed on the cap and are disposed at a distance from the outer surface thereof. The free ends of the arms are provided with inwardly projecting attachments that cooperate with undercut engagement means on the container.

Pursuant to an alternative embodiment, the receiving chamber can also be formed by a single or multi-piece sleeve or shell that can be placed upon the cap of the container and is made of plastic, metal, cardboard, or a similar material, with this shell having two or more concentric and radially resilient arms that can interlock or engage with the cap or with a collar formed on the container via attachments that are formed on the free ends of the arms.

In this connection, it is suitable to form the resilient arms by elongated slots that are formed in the shell, by slot-like recesses, etc., and to provide the sleeve, in that region that is associated with the mouth of the container, with a support element that projects concentrically inwardly and cooperates with the cap.

The sleeve can furthermore be provided with two partitions, such as arms and inserts, that are radially spaced from one another and define the receiving chamber, with at least one of these partitions being resilient in the radial direction, for example via the presence of elongated slots, and being adapted to engage with a cap or with a collar formed on the container. The inner partition or wall of the sleeve can be formed by a separate insert, with the outer and/or the inner partition or wall of the sleeve, in those end regions that face the container, possibly being provided with inwardly or outwardly projecting attachments for holding the enclosure.

It is furthermore advantageous if the attachments that can engage or interlock with the cap or the collar of the container are connected with the radially resilient arms via an intentional breaking area that is formed by a notch or the like.

With a closure that is constructed pursuant to the present invention, i.e. one that is provided with a receiving chamber and is detachably connected with the container, not only is it possible to place an enclosure in the receiving chamber, thereby making it possible to provide to the consumer reliable information concerning the contents of the container, but it is also readily recognizable if the closure has been prematurely opened or otherwise tampered with by third parties. This assures that the consumer will always receive an originally packaged product, and that interchange of the enclosure is precluded.

In addition to the previously outlined advantages, the inventive closure can also be produced economically and readily permits automation of the introduction of the enclosure into the receiving chamber of the closure prior to placement of the closure upon the container. Since in this way it is no longer necessary to have a separate packaging, containers can be stored and transported in a space-saving manner; the disposal of separate packages is also entirely eliminated. This permits an extremely diversified application for the inventive closure, especially since it is also easy to handle.

Further specific features of the present invention will be described in detail subsequently.

Description of Preferred Embodiments

Referring now to the drawings in detail, the closure that is illustrated in FIG. 1 and that is designated generally by the reference numeral 11 serves to close or seal off a container 1, here in the form of a bottle, the recessed or reduced-diameter neck 2 of which is provided with an external thread 4 upon which a cap 12 is screwed. In this way, the mouth of the container 1 is reliably sealed by the cap 12 that is placed thereupon.

Figure 2:
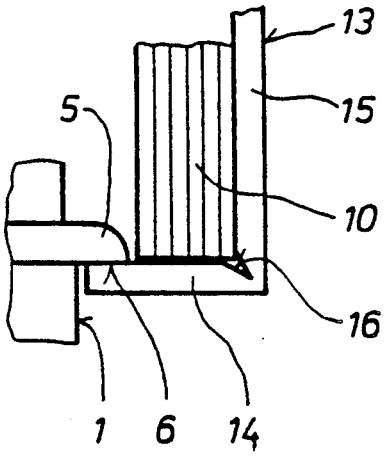
FIGS. 2 and 3 are enlarged views of portions of the closure of FIG. 1 in two different positions of the cap.
Figure 3:
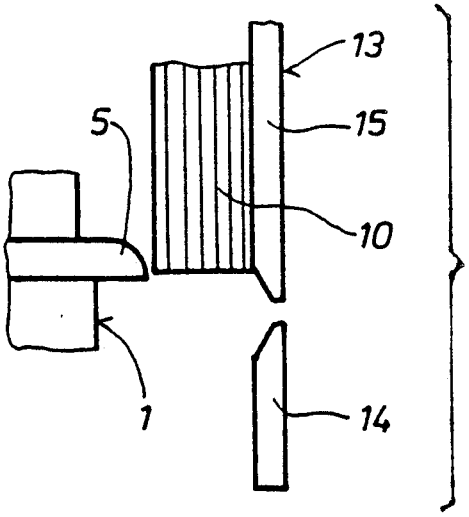

In order to be able to include with the container an enclosure 10, for example in the form of an information sheet, without thereby requiring an additional packaging, the closure 11 is provided with a receiving chamber 17 for the enclosure 10. In the embodiment illustrated in FIG. 1, the receiving chamber 17 is formed by a plurality of arms 13 that are formed on the cap 12 and are radially spaced from the outer surface thereof. The arms 13 are separated from one another in the circumferential direction by elongated recesses, for example in the form of the slots 15. Connected to the free ends of the arms 13 are inwardly projecting attachments 14. The attachments 14 are connected to the arms 13 via notches 16, as can be seen in particular in FIG. 2. This provides safety or intentional breaking areas, so that as soon as the cap 12 is unscrewed, the attachments 14 break off, as illustrated in FIG. 3.

Since as a result of the slots 15 the arm 13 are resilient, when the cap 12 is placed upon the container 1 the arms 13 are bent outwardly via the attachments 14 and via a collar 5 that is disposed on the neck 2 of the container. However, in the end position of the cap 12, the attachments 14 extend beneath the collar 5 and rest against the engagement means 6 formed by the collar. In contrast, when the cap 12 is unscrewed, the attachments 14 break off. Thus, it is easy to recognize whether or not the closure 11 has been tampered with. When the cap 12 has been unscrewed and the attachments 14 have broken off, the enclosure 10 can easily be removed from the receiving chamber 17.

Figure 4:
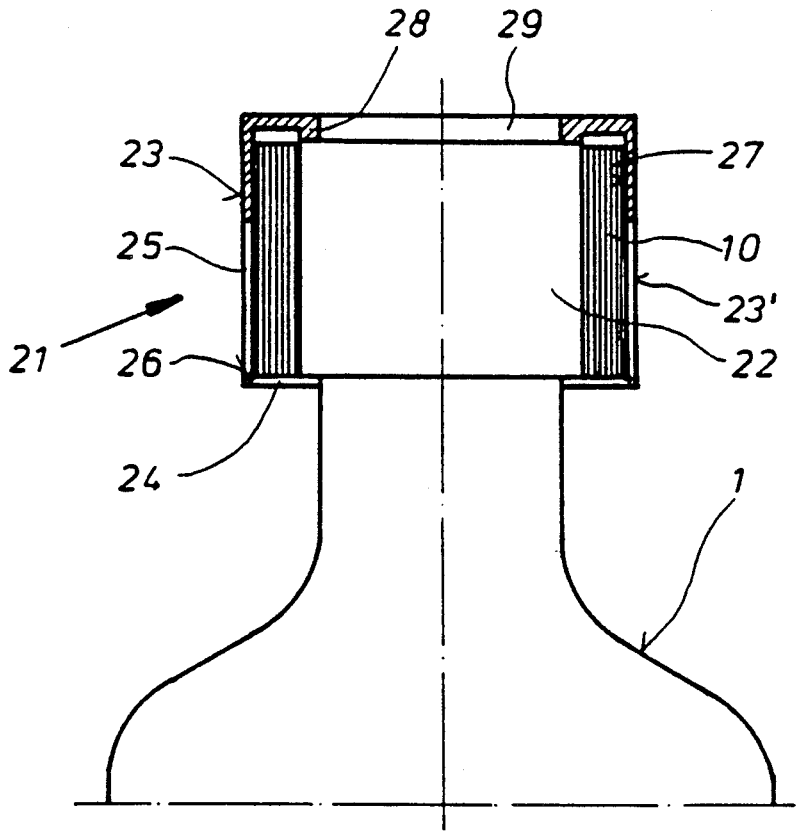
FIG. 4 shows a further exemplary embodiment of the inventive closure that is formed by a shell and has a receiving chamber.

In the embodiment illustrated in FIG. 4, for the closure 21 a receiving chamber 27 for the enclosure 10 is provided by a sleeve or shell 23 that is placed over the actual cap 22 of the container 1. Axially oriented slots 25 are formed in the shell 23, so that again resilient arms 23' are formed, on the free ends of which are connected attachments 24. These attachments 24, which are connected to the arms 23' via notches 26, extend beneath the cap 22 or the thread of the container 1, and break as soon as the cap is unscrewed or the shell 23 is pulled off. The shell 23 is reinforced by a support element 28 that surrounds an opening 29 that is concentrically provided in the shell 23.

Figure 5:
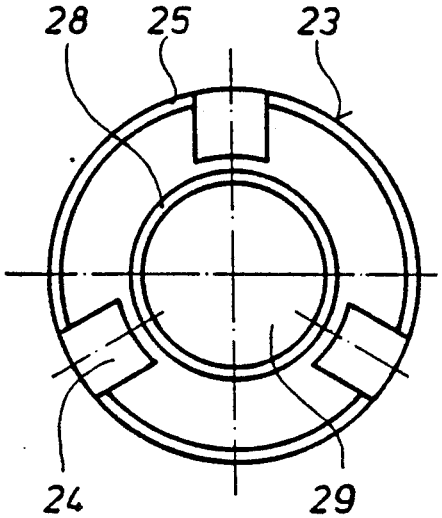
FIGS. 5 and 6 are bottom views of the shell of the closure of FIG. 4, and show two different embodiments thereof.
Figure 6:
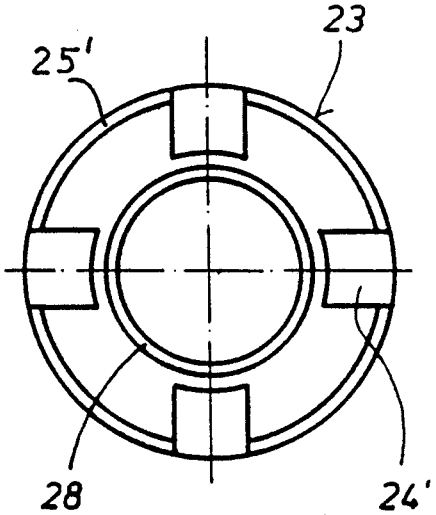

As shown in FIGS. 5 and 6, either three attachments 24 or four attachments 24' can be connected to the shell 23. In addition, it is to be understood that other arrangements for the attachments could also be utilized. However, in either case it is expedient to provide slots 25 or 25' in the shell 23 immediately adjacent the attachments 24 or 24' in order to ensure that when the shell 23, which is provided with the enclosure 10, is placed upon the container, the attachments 24, 24' can resiliently deflect outwardly.

Figure 8:
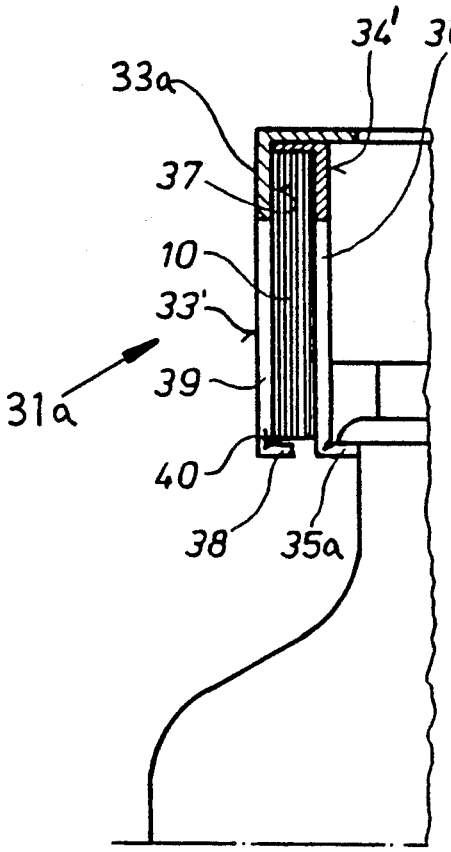
FIGS. 7 and 8 show two further exemplary embodiments of the inventive closure, which is provided with a receiving chamber.
Figure 7:
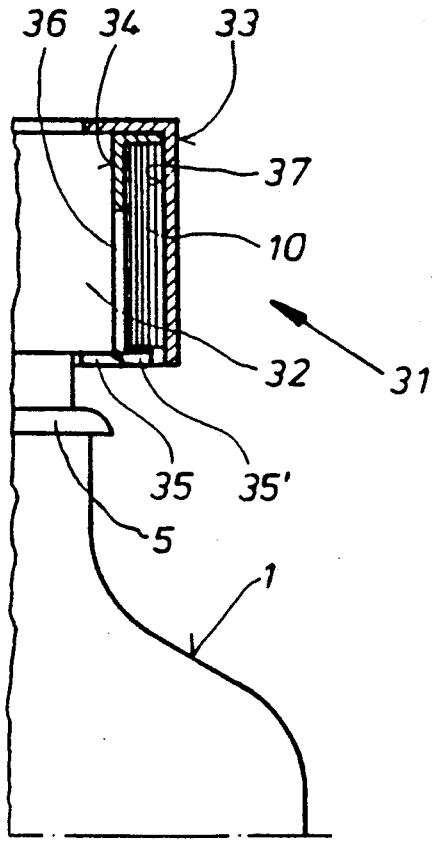

In the closure 31 illustrated in FIGS. 7 and 8, a receiving chamber 37 is formed by a double-walled sleeve or shell 33. A separate insert 34 is disposed in the shell in order to separate the receiving chamber 37 from the cap 32 of the container 1.

As shown in FIG. 7, formed on the free end of the insert 34 are inwardly projecting attachments 35 as well as outwardly projecting attachments 35', with elongated slots 36 being formed in the insert 34, so that when the shell 33 is being placed on, the insert 34 can deflect outwardly. The attachments 35 engage below the cap 32 and break off when the shell 33 is pulled off or when the cap 32 is unscrewed. In contrast, the attachments 35' serve to hold the enclosure 10 in the receiving chamber 37.

In the modified embodiment illustrated in FIG. 8, slots 39 are again formed in the shell **33*a*, thereby forming resilient arms 33'. At their inner ends, the arms 33' are provided with inwardly projecting attachments 38 for holding the enclosure 10 in the receiving chamber 37. The attachments 35*a*, which are again provided on the insert 34' and are connected therewith via notches 40, and which break off when the closure 31*a*** is opened, ensure that it is easy to recognize whether or not the cap of the container has been tampered with.

The present invention is, of course, in no way restricted to the specific disclosure of the specification and drawings, but also encompasses any modifications within the scope of the appended claims.

What we claim is:

1. In a combination of a container and a closure therefor, with said closure including a cap that can be placed onto a mouth of said container, the improvement wherein:

said closure, in order to accommodate an enclosure, is provided with a receiving chamber that is disposed concentric to and radially outwardly of said cap; and at least two radially resilient arms that are formed on said cap and are spaced from an outer surface thereof, with said receiving chamber being disposed between said arms and said cap, with each of said arms having a free end that is provided with an inwardly projecting attachment that cooperates with engagement means disposed on said container for detachably connecting said closure to said container.

2. A combination according to claim 1, in which said engagement means is in the form of a collar on said container.

3. A combination according to claim 1, in which said attachments are connected to said arms via an intentional breaking area.

4. A combination according to claim 3, in which said intentional breaking area is a notch.

5. In a combination of a container and a closure therefor, with said closure including a cap that can be placed onto a mouth of said container, the improvement wherein:

said closure, in order to accommodate an enclosure, is provided with a receiving chamber that is disposed concentric to and radially outwardly of said cap; and a shell that is placed on said cap and has at least two concentric, radially resilient arms to form said receiving chamber, with at least some of said arms being provided with an attachment that engages cap engagement means for detachably connecting said closure to said container.

6. A combination according to claim 5, in which said resilient arms are formed by slot-like means formed in said shell.

7. A combination according to claim 6, in which in that portion thereof that is associated with a mouth of said container, said shell is provided with a support element that projects concentrically inwardly and co-operates with said cap.

8. A combination according to claim 5, in which said engagement means is in the form of a collar on said container.

9. A combination according to claim 8, in which said shell is provided, as said arms, with radially spaced-apart partition means that define said receiving chamber between them, with at least one of said partition means being resilient in a radial direction and engaging cap engagement means.

10. A combination according to claim 9, which includes slot-like means in said partition means to provide a resilient configuration therefor.

11. A combination according to claim 9, in which said shell has a multi-part configuration.

12. A combination according to claim 11, in which an inner one of said partition means is in the form of a separate insert.

13. A combination according to claim 9, in which at least one of said partition means, in an end portion thereof that faces said container, is provided with an inwardly projecting attachment for holding said enclosure in said receiving chamber.

14. A combination according to claim 5, in which said attachments are connected to said at least some of said arms via an intentional breaking area.

15. A combination according to claim 14, in which said intentional breaking area is a notch.

16. A combination according to claim 9, in which at least one of said partition means, in an end portion thereof that faces said container, is provided with an outwardly projecting attachment for holding said enclosure in said receiving chamber.

* * * * *